US009186786B2

(12) United States Patent
Rosales

(10) Patent No.: US 9,186,786 B2
(45) Date of Patent: Nov. 17, 2015

(54) FASTENER REMOVAL DEVICE

(76) Inventor: Israel F. Rosales, La Puente, CA (US)

( * ) Notice: Subject to any disclaimer, the term of this patent is extended or adjusted under 35 U.S.C. 154(b) by 0 days.

(21) Appl. No.: 13/586,630

(22) Filed: Aug. 15, 2012

(65) Prior Publication Data

US 2013/0043444 A1 Feb. 21, 2013

Related U.S. Application Data

(60) Provisional application No. 61/575,157, filed on Aug. 15, 2011.

(51) Int. Cl.

| | |
|---|---|
| ***B66F 1/00*** | (2006.01) |
| ***B25C 11/00*** | (2006.01) |
| ***B25B 13/04*** | (2006.01) |

(52) U.S. Cl.

CPC ..... *B25C 11/00* (2013.01); *B25B 13/04* (2013.01)

(58) Field of Classification Search

USPC ..... 254/25, 26 R

See application file for complete search history.

(56) References Cited

U.S. PATENT DOCUMENTS

| | | | | | |
|---|---|---|---|---|---|
| 82,568 | A | * | 9/1868 | Tyzick et al. | 254/22 |
| 199,959 | A | * | 2/1878 | Chapman | 7/145 |
| 317,738 | A | * | 5/1885 | Crosby | 7/127 |
| 704,006 | A | * | 7/1902 | Dempsey | 81/23 |
| 2,574,304 | A | * | 11/1951 | Bonancio | 81/23 |
| 2,599,651 | A | * | 6/1952 | McClung | 81/23 |
| 3,927,432 | A | * | 12/1975 | Dahl | 7/145 |
| 4,482,132 | A | * | 11/1984 | Lamansky | 254/26 R |
| 4,561,635 | A | * | 12/1985 | Lamansky | 254/26 R |
| 5,159,858 | A | * | 11/1992 | Gansen | 81/23 |
| 5,441,236 | A | * | 8/1995 | Kiernan | 254/26 E |
| 5,595,369 | A | * | 1/1997 | Hull | 254/26 R |
| 5,852,959 | A | * | 12/1998 | Speare | 81/23 |
| 6,105,935 | A | | 8/2000 | Wagner | |
| 6,186,479 | B1 | | 2/2001 | Witter | |
| 6,308,934 | B1 | | 10/2001 | Gallo | |
| 6,314,599 | B1 | * | 11/2001 | Hay | 7/117 |
| D502,076 | S | * | 2/2005 | Stewart | D8/79 |
| 6,923,432 | B1 | * | 8/2005 | Martinez | 254/26 R |
| 7,096,530 | B2 | * | 8/2006 | Goulet | 15/144.4 |
| D534,050 | S | * | 12/2006 | Stewart | D8/79 |
| 7,438,279 | B2 | * | 10/2008 | Eby et al. | 254/25 |
| 8,047,099 | B2 | * | 11/2011 | St. John et al. | 81/20 |
| 8,113,488 | B2 | * | 2/2012 | Stewart | 254/26 R |
| 8,177,192 | B1 | * | 5/2012 | Taylor et al. | 254/26 E |
| 2007/0114501 | A1 | * | 5/2007 | Eby et al. | 254/25 |
| 2010/0038609 | A1 | * | 2/2010 | Chen | 254/26 R |
| 2010/0116096 | A1 | * | 5/2010 | Hanlon | 81/22 |

* cited by examiner

*Primary Examiner* — Lee D Wilson
*Assistant Examiner* — Alvin Grant
(74) *Attorney, Agent, or Firm* — Ruth Eure

(57) ABSTRACT

A fastener removal device comprising a handle and a head, wherein there is a first end of the handle and a second end, the second end forming a toothed pad, wherein one end of the head is shaped as a toothed pad, wherein the other end of the head is shaped as a bifurcated claw, wherein said head contains an opening in the middle, such that the second end of the handle extends through the opening in the head.

4 Claims, 2 Drawing Sheets

FASTENER REMOVAL DEVICE

CROSS-REFERENCE TO RELATED APPLICATIONS

The present application claims priority under 35 USC 119 (e) (1) from U.S. Provisional Patent Application, Ser. No. 61/575,157 filed Aug. 15, 2011 for Nail Bar or Nail Remover Bar, of common inventorship.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

FIELD OF THE INVENTION

The present invention pertains to the field of hand tools, and more specifically to the field of hand tools for extracting nails, staples and fasteners from surfaces.

BACKGROUND OF THE INVENTION

Fasteners are hardware devices that mechanically join or affix two or more objects together. Usually fashioned from metal, common types of fasteners include nails, bolts, screws, clips, staples, clamps, pins, grommets, anchors, and rivets. Despite advances in building and tool technology, there is a need for a reliable tool for pulling nails, especially short, cut off and headless nails, staples and tacks that are impossible to pull with a standard claw hammer that functions without causing damage to the surface or drywall from which one is removing the fastener. Traditionally a claw hammer is used to remove nails, staples or other fasteners but the end of the claw can leave scratches or indentions on the wall or drywall.

The prior art has put forth several designs for hand held tools for nail and framework removal. Among these are:

U.S. Pat. No. 6,308,934 to Mark Anthony Gallo describes a pry bar with a built in hammer. The pry bar includes a slide bar with an elongated linear section culminating in a slightly angled pry section at one end. At the other end of the slide bar is a pry section angled at approximately ninety degrees. This tool is adjustable by means of the slide bar to accommodate various space allotments.

U.S. Pat. No. 6,186,479 to Lowell F. Witter describes a framework removal tool that is designed to remove variously sized stakes that support concrete framework. This tool provides an apparatus and method for pulling nails, prying framework and removing different types of stakes using a convenient leverage design. At one end, this elongated tool comprises a stake contact element with two adjustable notches for accommodating stake lengths and a rotatable lever arm connecting to the stake contact element for stake removal. The other end of this tool composes a notch for removing nails.

U.S. Pat. No. 6,105,935 to Jefferson Louis Wagner describes a nail removal tool for pulling an elongated object that is embedded in a body having a surface through a surface. This tool comprises an elongated shaft portion with one end comprising a handle and the other end comprising a pivot mechanism. A moveable head portion with a fixed jaw member and a jaw bedway is attached to the pivot mechanism. A second jaw member parallel to the first jaw member is attached to a moveable bedway plate that is inserted in the jaw bedway and is moveably connected to the lower end of the shaft portion. This tool has a jaws closed position and opposite jaws open position.

None of these prior art references describe the present invention.

SUMMARY OF THE INVENTION

It is an object of the present invention to provide an improved hand held tool for extracting nails, staples and fasteners from surfaces.

DETAILED DESCRIPTION OF THE INVENTION

Figure 1:
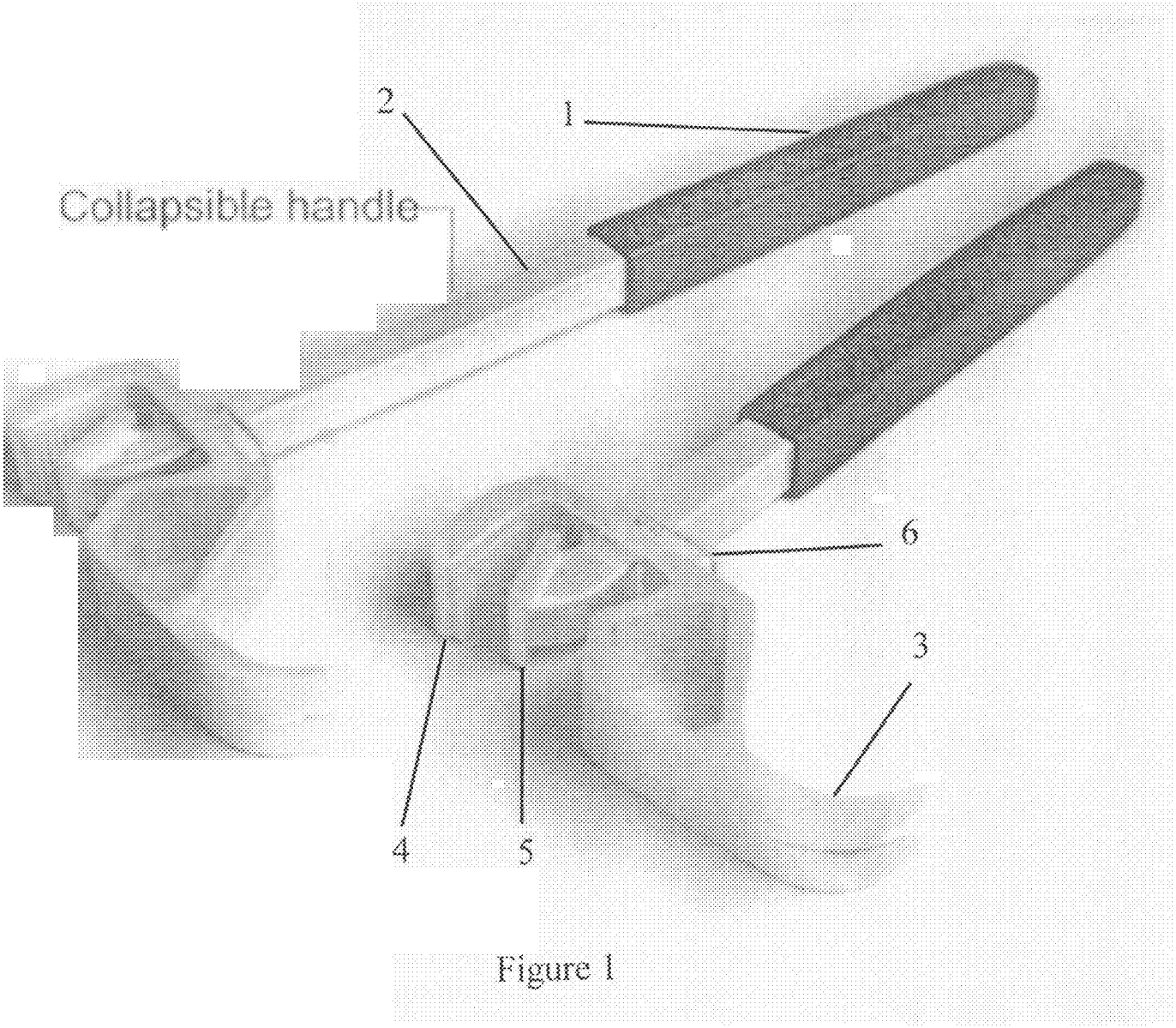
FIG. 1 comprises two perspective views of the present invention showing claws, gripping jaws, a collapsible handle, and a hand grip. The first view illustrates the present invention at its fully extended length. The second view illustrates the present invention its fully collapsed position.
Figure 2:
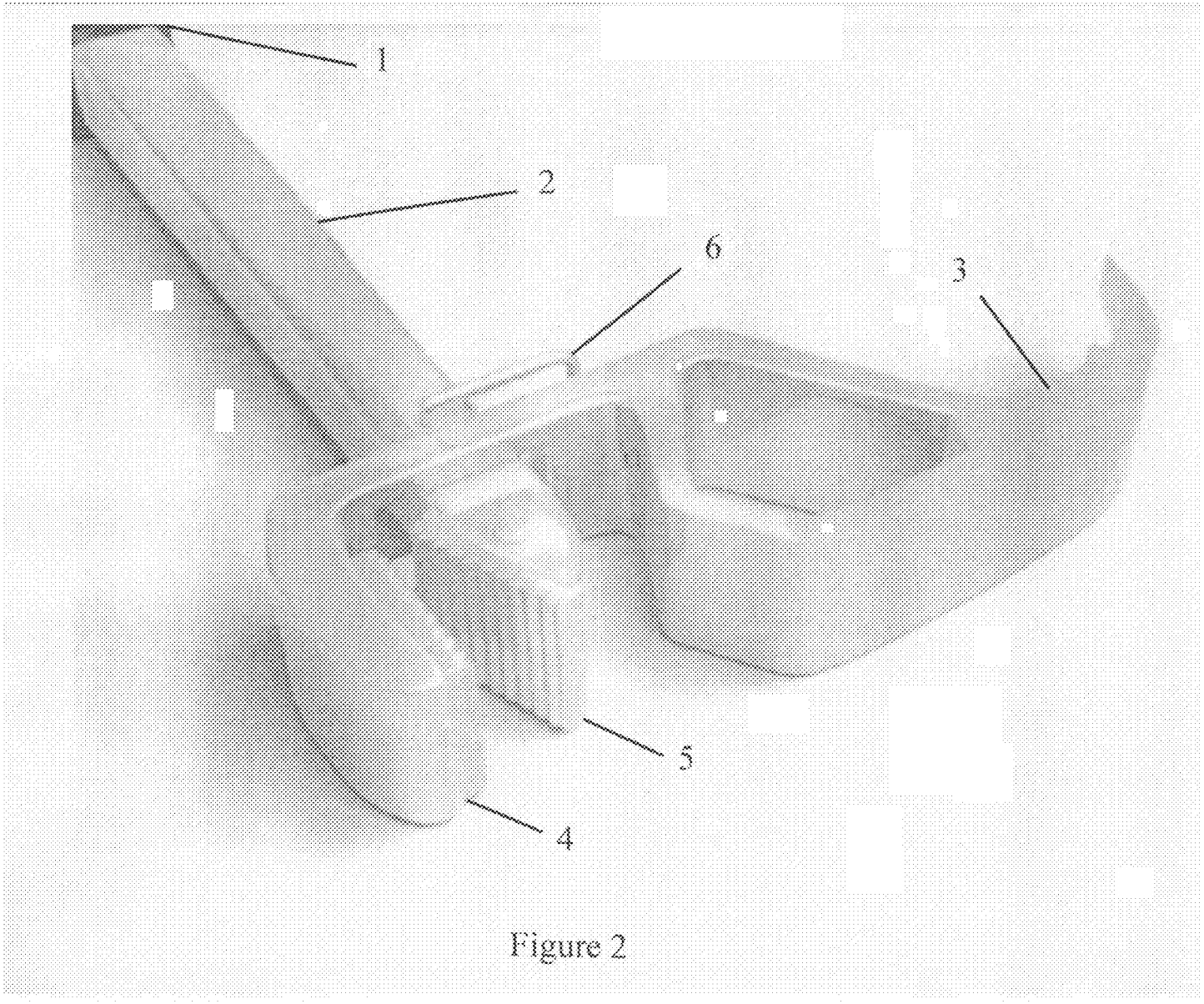
FIG. 2 is a zoom perspective view of the distal end of the present invention showing the collapsible portion of the handle and a heavy duty claw and a set of gripping jaws.

The present invention, as shown in FIGS. 1 and 2, is a fastener removal device is a hand tool designed expressly for removing nails, staples, tacks and other fasteners having a handle and a head that comprises a set of toothed articulating jaws and a claw. This fastener removal device is fabricated in vanadium steel bar. The present invention is comprised of three sections. The first and proximal section is a hand grip [1] fabricated in molded plastic, rubber or polymeric foam hand grip. The middle section is a shaft [2] in steel tubing. The hand grip and shaft make up the handle of the fastener removal device. This metal shaft contains a telescoping self locking and sliding shaft within shaft construction such that at its full extension is approximately two feet and its minimum extension is approximately one foot. The third and distal section is the head, one side of which is a curved and angled claw [3] for removing nails that have retained their heads or aren't sunk too deep within the surface, and the other end are two opposing toothed pads. The outside pad [4] works with an opposing identically toothed inside pad [5] to close as a pair of jaws on a nail. The head of this fastener removal device connected to the shaft by a pivot pin [6] allowing the outside and inside pads to open and close and permitting the bottom of the tool to function as a rocker arm. Once a nail or other object is seized by the opposing toothed pads of the present device, the user pulls back on the hand grip and rooks the device backward and upward by virtue of the curved and angled claw [3] foot. This easily exerted leverage serves to grip the nail more tightly and pull it out more quickly. The outside pad at the end of the tool's shaft is removable with a cavity behind it used for storing additional gripper pads with finer or coarser teeth. The shaft band pad is held in place by a snap lock and released by a push button situated on the lower end of the shaft. The telescoping shaft comprises a sliding pin and hole, lock and release mechanism so the shaft is locked at minimum extension for storage or transport, and then released for extension when optimal leverage is required.

This fastener removal device provides carpenters and other construction industry personnel, as well as do it yourself householders, with an improved tool for removing even the most stubborn nails and other fasteners. The present invention functions quickly and easily without any damage to the wood, drywall or surface to which it is applied. Solidly built of tool grade steel, the rugged and heavy duty device provides two modes of high leverage pulling. One mode is a tough claw pull for fasteners that are easier to remove and the other mode is a pair of articulating jaws for fasteners that are more challenging to remove.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

I claim:

1. A device comprising a handle and a head, wherein there is a first end of the handle and a second end, the second end forming a toothed pad, wherein one end of the head is shaped as a toothed pad, wherein the other end of the head is shaped as a bifurcated claw, wherein said head contains an opening in the middle, such that the second end of the handle extends through the opening in the head and wherein the second end of the handle forming the toothed pad and the end of the head shaped as a toothed pad oppose each other allowing the toothed pads to open and close as a pair of jaws and wherein the head is attached to the handle by means of a pivot pin.

2. The device of claim 1, wherein the handle is collapsible.

3. The device of claim 1, wherein the device is comprised of aluminum.

4. The device of claim 1, wherein the device is comprised of vanadium steel.

* * * * *